US008686652B2

(12) United States Patent
Shin et al.

(10) Patent No.: US 8,686,652 B2
(45) Date of Patent: Apr. 1, 2014

(54) REFERENCE VOLTAGE GENERATING CIRCUIT AND LED DRIVER CIRCUIT HAVING THE SAME THEREIN

(75) Inventors: Du-su Shin, Cheongju-si (KR); Shane Baik, Cheongju-si (KR); Chang-sik Lim, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 58 days.

(21) Appl. No.: 13/316,897

(22) Filed: Dec. 12, 2011

(65) Prior Publication Data

US 2012/0153848 A1 Jun. 21, 2012

(30) Foreign Application Priority Data

Dec. 21, 2010 (KR) ..... 10-2010-0131750

(51) Int. Cl.
*H05B 37/02* (2006.01)

(52) U.S. Cl.
USPC ..... 315/192; 315/307; 315/360

(58) Field of Classification Search
USPC ..... 315/192, 185 R, 297, 307, 312, 360
See application file for complete search history.

(56) References Cited

U.S. PATENT DOCUMENTS

2009/0273288 A1* 11/2009 Zhao et al. ..... 315/185 R
2009/0295775 A1* 12/2009 Kim et al. ..... 345/212
2010/0072922 A1* 3/2010 Szczeszynski et al. ..... 315/297
2010/0148679 A1* 6/2010 Chen et al. ..... 315/185 R

* cited by examiner

*Primary Examiner* — Daniel D Chang
(74) *Attorney, Agent, or Firm* — NSIP Law

(57) ABSTRACT

A reference voltage generating circuit used for a light-emitting diode (LED) driver circuit and a light-emitting diode (LED) driver circuit are provided. A reference voltage generating circuit used for a light-emitting diode (LED) driver circuit includes a voltage measurer configured to sequentially measure feedback voltages of a plurality of LED arrays, the LED arrays being connected to one another in parallel, a quantizer configured to search for one of the plurality of LED arrays having a lowest feedback voltage of the measured feedback voltages, a comparator configured to compare an output of the voltage measurer with a preset comparison voltage to generate a reference voltage, and a timing controller configured to control the comparator to output the generated reference voltage corresponding to the one of the plurality of LED arrays.

17 Claims, 4 Drawing Sheets

REFERENCE VOLTAGE GENERATING CIRCUIT AND LED DRIVER CIRCUIT HAVING THE SAME THEREIN

CROSS-REFERENCE TO RELATED APPLICATION

This application claims the benefit under 35 U.S.C. §119 (a) of Korean Patent Application No. 10-2010-0131750, filed on Dec. 21, 2010, in the Korean Intellectual Property Office, the entire disclosure of which is incorporated herein by reference for all purposes.

BACKGROUND

1. Field

The following description relates to a reference voltage generating circuit and a light-emitting diode (LED) driver circuit having the same therein, and, for example, a reference voltage generating circuit which is capable of outputting a reference voltage, which corresponds to one of a plurality of LED strings having a lowest feedback voltage, at a timing when measuring the lowest feedback voltage of the corresponding LED string, and an LED driver circuit having the same.

2. Description of Related Art

A liquid crystal display (LCD) has a thinner thickness, a lighter weight, a lower driving voltage, and lower power consumption than other display types and, thus, has been widely used. However, the LCD is a non-emitting device that does not self-emit light and, thus, requires an additional backlight source to supply light to a liquid crystal panel.

A cold cathode fluorescent lamp (CCFL), a light-emitting diode (LED), or the like are often used as LCD panel backlight sources. Since the CCFL uses mercury, the CCFL causes environmental pollution, has a slow response speed, a low color reproduction, and is inappropriate to make a LCD panel light, thin, short, and small.

Since the LED does not use an environmental pollutant, the LED is environment-friendly and enables impulse driving. The LED also has a high color reproduction, is able to adjust light amounts of red, green, and blue LEDs to arbitrarily change a luminance, a color temperature, etc., and is appropriate to make a LCD panel light, thin, short, and small. Therefore, the LED has been often used as a backlight source of a LCD panel, etc.

If LED arrays, each of which includes a plurality of LEDs, are connected to one another in parallel in a LCD backlight unit (BLU) using LEDs, a driver circuit capable of supplying a constant current to each of the LED arrays is required. In addition, a dimming circuit is required to arbitrarily adjust a luminance, a color temperature, etc., or to compensate for a temperature.

For example, in order to maintain uniform brightness and color in backlight, all LEDs are driven by the same current regardless of feedback voltages Vf of the LEDs. For this control, a conventional technique uses a dynamic bus voltage regulation method to move a bus voltage $V_{BUS}$ according to deviations of LED arrays.

If the dynamic bus voltage regulation method is used, efficiency is improved. However, an output voltage fluctuates, and thus audible noise is generated.

SUMMARY

In one general aspect, there is provided a reference voltage generating circuit used for a light-emitting diode (LED) driver circuit, the reference voltage generating circuit including a voltage measurer configured to sequentially measure feedback voltages of a plurality of LED arrays, the LED arrays being connected to one another in parallel, a quantizer configured to search for one of the plurality of LED arrays having a lowest feedback voltage of the measured feedback voltages, a comparator configured to compare an output of the voltage measurer with a preset comparison voltage to generate a reference voltage, and a timing controller configured to control the comparator to output the generated reference voltage corresponding to the one of the plurality of LED arrays.

The general aspect of the reference voltage generating circuit may further provide that the voltage measurer is further configured to sequentially measure voltages of nodes having differences between voltages of the plurality of LED arrays and a voltage that is commonly supplied to the plurality of LED arrays to determine the feedback voltages of the plurality of LED arrays.

The general aspect of the reference voltage generating circuit may further provide that the quantizer is further configured to search for the one of the plurality of LED arrays having the lowest feedback voltage of the measured feedback voltages and a timing when measuring the lowest feedback voltage of the one of the plurality of LED arrays.

The general aspect of the reference voltage generating circuit may further provide that the timing controller is further configured to output an output of the comparator as a reference voltage for driving the plurality of LED arrays at the timing by using a first switch disposed at an output port of the comparator.

The general aspect of the reference voltage generating circuit may further provide that the timing controller is further configured to supply an output of the voltage measurer to a negative input port of the comparator at the timing by using a second switch disposed at the negative input port of the comparator.

The general aspect of the reference voltage generating circuit may further provide a reference voltage controller configured to provide the preset comparison voltage to the comparator, the preset comparison voltage being one of a plurality of preset comparison voltages, the one of the plurality of preset comparison voltages being selected to be the preset comparison voltage according to a level of the lowest feedback voltage.

The general aspect of the reference voltage generating circuit may further provide that the plurality of preset comparison voltages includes a first comparison voltage and a second comparison voltage that is less than the first comparison voltage, if the level of the lowest feedback voltage is greater than a preset reference voltage difference, the reference voltage controller provides the first comparison voltage as the preset comparison voltage to the comparator, and, if the level of the lowest feedback voltage is less than the preset reference voltage difference, the reference voltage controller provides the second comparison voltage as the preset comparison voltage to the comparator.

The general aspect of the reference voltage generating circuit may further provide that the reference voltage controller is further configured to provide a comparison voltage having a hysteresis form as the preset comparison voltage to the comparator.

In another general aspect, there is provided an LED driver circuit, including a plurality of LED arrays, the LED arrays being connected to one another in parallel, a reference voltage generating circuit configured to sequentially measure feedback voltages of the plurality of LED arrays, and output a reference voltage corresponding to a lowest feedback voltage at a timing when measuring the lowest feedback voltage of an LED string having the lowest feedback voltage, a pulse width modulation (PWM) signal generator configured to generate a PWM signal according to the generated reference voltage, and a direct current (DC)-to-DC converter configured to provide an output voltage to the plurality of LED arrays using the generated PWM signal.

The general aspect of the LED driver circuit may further provide that the reference voltage generating circuit includes a voltage measurer configured to sequentially measure the feedback voltages of the plurality of LED arrays, a quantizer configured to search for one of the plurality of LED arrays having the lowest feedback voltage of the measured feedback voltages, a comparator configured to compare an output of the voltage measurer with a preset comparison voltage to generate the reference voltage, and a timing controller configured to control the comparator to output the generated reference voltage corresponding to the one of the plurality LED arrays.

The general aspect of the LED driver circuit may further provide that the voltage measurer is further configured to sequentially measure voltages of nodes having differences between voltages of the plurality of LED arrays and the output voltage provided from the DC-DC converter, to measure the feedback voltages of the plurality of LED arrays.

The general aspect of the LED driver circuit may further provide that the quantizer is further configured to search for the one of the plurality of LED arrays having the lowest feedback voltage of the measured feedback voltages and a timing when measuring the lowest feedback voltage of the one of the plurality of LED arrays.

The general aspect of the LED driver circuit may further provide that the timing controller is further configured to provide an output of the comparator to the PWM signal generator at the timing.

The general aspect of the LED driver circuit may further provide that the timing controller is further configured to supply the feedback voltages, which are measured by the voltage measurer, to a negative input port of the comparator at the timing.

The general aspect of the LED driver circuit may further provide that the reference voltage generating circuit further includes a reference voltage controller configured to provide the preset comparison voltage to the comparator, the preset comparison voltage being one of a plurality of preset comparison voltages, the one of the plurality of preset comparison voltages being selected to be the preset comparison voltage according to a level of the lowest feedback voltage.

The general aspect of the LED driver circuit may further provide that the plurality of preset comparison voltages includes a first comparison voltage and a second comparison voltage that is less than the first comparison voltage, if the level of the lowest feedback voltage is greater than a preset reference voltage difference, the reference voltage controller provides the first comparison voltage as the preset comparison voltage to the comparator, and, if the level of the lowest feedback voltage is less than the preset reference voltage difference, the reference voltage controller provides the second comparison voltage as the preset comparison voltage to the comparator.

The general aspect of the LED driver circuit may further provide that the reference voltage controller is further configured to provide a comparison voltage having a hysteresis form as the preset comparison voltage to the comparator.

Other features and aspects may be apparent from the following detailed description, the drawings, and the claims.

Figure 1:
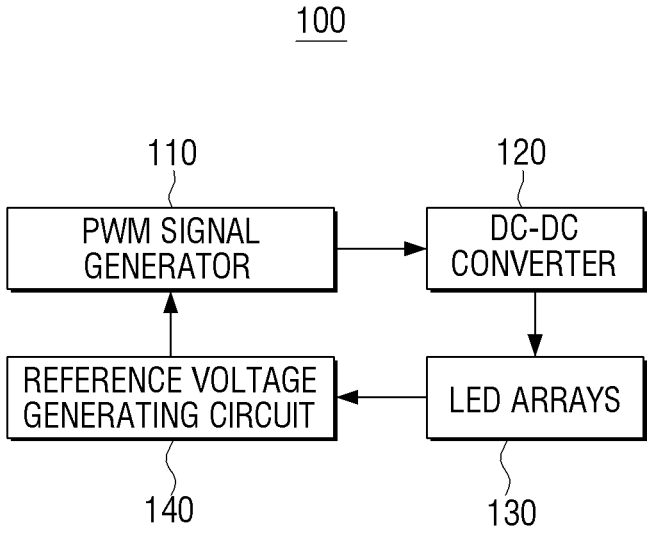
FIG. 1 is a block diagram illustrating an example of a light-emitting diode (LED) driver circuit.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 is a block diagram illustrating an example of a light-emitting diode (LED) driver circuit 100.

Referring to FIG. 1, the LED driver circuit 100 includes a pulse width modulation (PWM) signal generator 110, a direct current (DC)-to-DC (DC-DC) converter 120, a plurality of LED arrays 130, and a reference voltage generating circuit 140.

The PWM signal generator 110 generates a PWM signal according to a reference voltage. For example, the PWM signal generator 110 receives a reference voltage VREF and an output voltage VOFB generated by the reference voltage generating circuit 140, which will be described later, to generate the PWM signal. A detailed structure of the PWM signal generator 110 will be described later with reference to FIG. 2.

The DC-DC converter 120 provides an output voltage to the plurality of LED arrays 130 using the PWM signal. For example, the DC-DC converter 120 converts a DC voltage based on the PWM signal generated by the PWM signal generator 110 and provides the converted DC voltage to the plurality of LED arrays 130 connected to one another in parallel.

The reference voltage generating circuit 140 sequentially measures feedback voltages (or forward voltages; hereafter "feedback voltages") of the plurality of LED arrays 130. The reference voltage generating circuit 140 outputs a reference voltage, which corresponds to a lowest feedback voltage of an LED string having the lowest feedback voltage, at a timing when measuring the lowest feedback voltage of the LED string. Detailed structure and operation of the reference voltage generating circuit 140 will be described later with reference to FIGS. 2 through 4.

Figure 2:
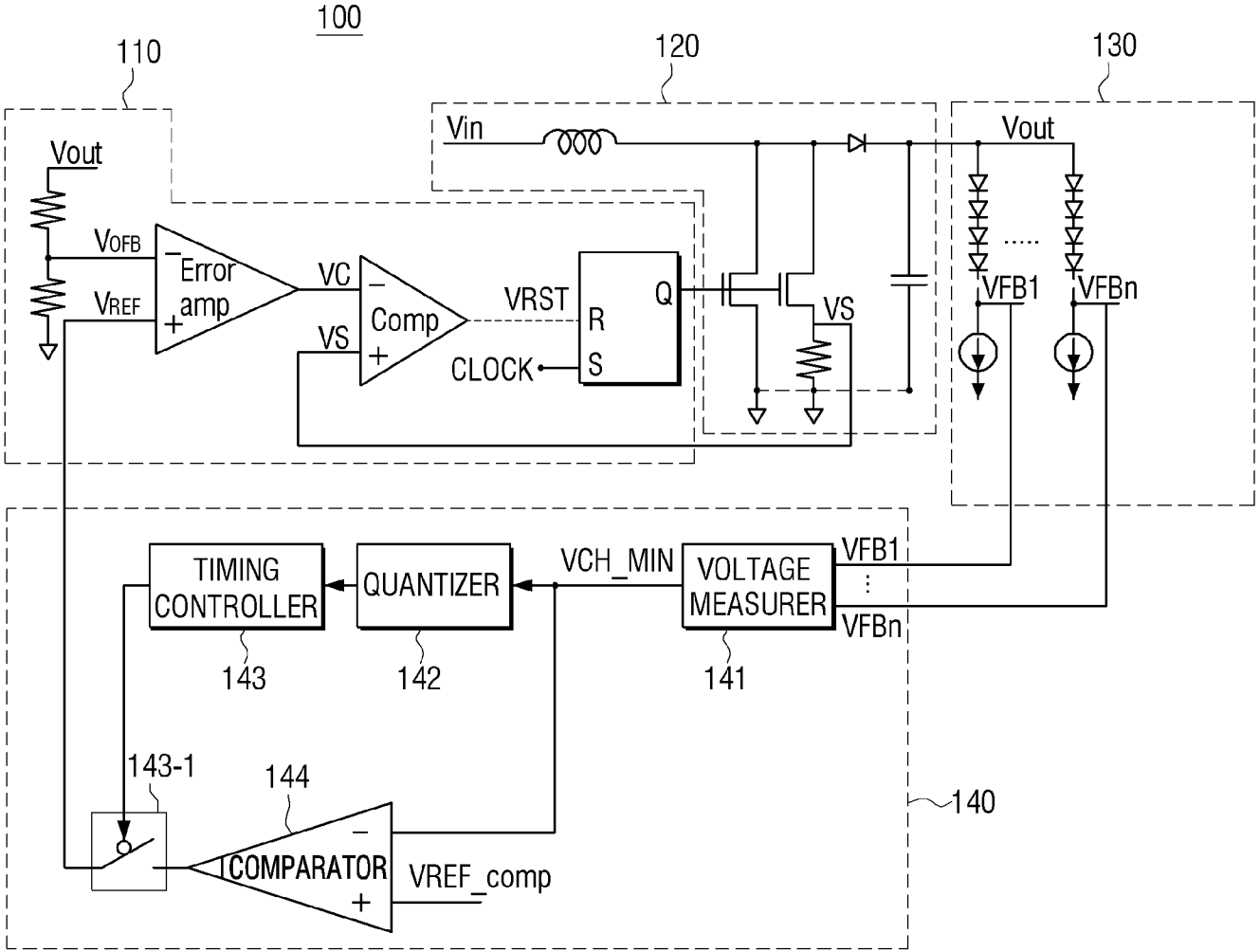
FIG. 2 is a circuit diagram illustrating an example of the LED driver circuit of FIG. 1.

FIG. 2 is a circuit diagram illustrating an example of the LED driver circuit 100 of FIG. 1.

Referring to FIG. 2, the LED driver circuit 100 includes the PWM signal generator 110, the DC-DC converter 120, the plurality of LED arrays 130, and the reference voltage generating circuit 140.

The PWM signal generator 110 generates a PWM signal that is to be provided to the DC-DC converter 120. For example, the PWM signal generator 110 includes an error amplifier (Error amp), a comparator (Comp), and a reset-set (RS) latch. The error amplifier receives a reference voltage VREF through a positive input port from the reference voltage generating circuit 140, receives a resistance port voltage $V_{OFB}$, which is divided from an output voltage Vout, through a negative input port, and outputs a difference VC between the reference voltage VREF and the resistance port voltage $V_{OFB}$. The comparator receives the difference VC output from the error amplifier through a negative input port, receives a sensing voltage VS through a positive input port, and outputs a difference between the difference VC and the sensing voltage VS as a reset signal VRST. The RS latch receives an output of the comparator as the reset signal VRST, receives a reference clock for determining a switching frequency as a set signal, and generates the PWM signal of a general current mode control.

The DC-DC converter 120 includes a boost switcher having an inductor, a boost gate, and a diode. The DC-DC converter 120 shown in FIG. 2 performs the same operation as a general boost switcher, and thus its detailed descriptions will be omitted herein.

The reference voltage generating circuit 140 sequentially measures feedback voltages of the plurality of LED arrays 130. The reference voltage generating circuit 140 also outputs the reference voltage VREF, which corresponds to a lowest feedback voltage of an LED string having the lowest feedback voltage, at a timing when measuring the lowest feedback voltage of the LED string. For example, the reference voltage generating circuit 140 includes a voltage measurer 141, a quantizer 142, a timing controller 143, and a comparator 144 (or I generator).

The voltage measurer 141 sequentially measures the feedback voltages of the plurality of LED arrays 130, which are connected to one another in parallel. For example, the voltage measurer 141 sequentially measures voltages VFB1 . . . , and VFBn of nodes having voltage differences of the plurality of LED arrays 130 from the output voltage Vout, which is commonly supplied to the plurality of LED arrays 130, to sequentially measure the feedback voltages of the plurality of LED arrays 130. The voltage measurer 141 operates as a buffer to store the measured feedback voltages of the plurality of LED arrays 130 for a preset time.

The quantizer 142 searches for one (or a channel) of the plurality of LED arrays 130 having the lowest feedback voltage of the measured feedback voltages. For example, the quantizer 142 searches for the LED array of the plurality of LED arrays 130 having the lowest feedback voltage of the sequentially measured feedback voltages and searches for a timing when measuring the lowest feedback voltage of the searched LED array of the plurality of LED arrays 130.

The timing controller 143 controls the comparator 144 to output the reference voltage VREF corresponding to the searched LED array 130 of the plurality of LED arrays 130. For example, the timing controller 143 controls the comparator 144 using a first switch 143-1 disposed at an output port of the comparator 144 to output the reference voltage VREF generated by the comparator 144 only at the timing searched by the quantizer 142.

In addition, since the voltage measurer 141 sequentially measures the feedback voltages of the plurality of LED arrays 130, the comparator 144 sequentially receives the feedback voltages of the plurality of LED arrays 130 and sequentially outputs differences between the sequentially received feedback voltages and the comparison voltage VREF_comp. However, the timing controller 143 controls the comparator 144 to provide an output of the comparator 144 to the PWM signal generator 110 only at the timing searched by the quantizer 142.

The timing controller 143 may control the comparator 144 using a second switch, which is disposed at a negative input port of the comparator 144, to supply an output of the voltage measurer 141 to a negative input port of the PWM signal generator 110 only at the timing when measuring the lowest feedback voltage and to output the reference voltage VREF corresponding to the lowest feedback voltage. This will be described later with reference to FIG. 4.

The comparator 144 compares the output of the voltage measurer 141 with a preset comparison voltage VREF_comp to generate the reference voltage VREF. For example, the comparator 144 may be realized as an operational amplifier (OP-AMP), receive the output of the voltage measurer 141 through the negative input port, receive the comparison voltage VREF_comp through the negative input port, and output a difference between the output of the voltage measurer 141 and the comparison voltage VREF_comp.

Figure 3:
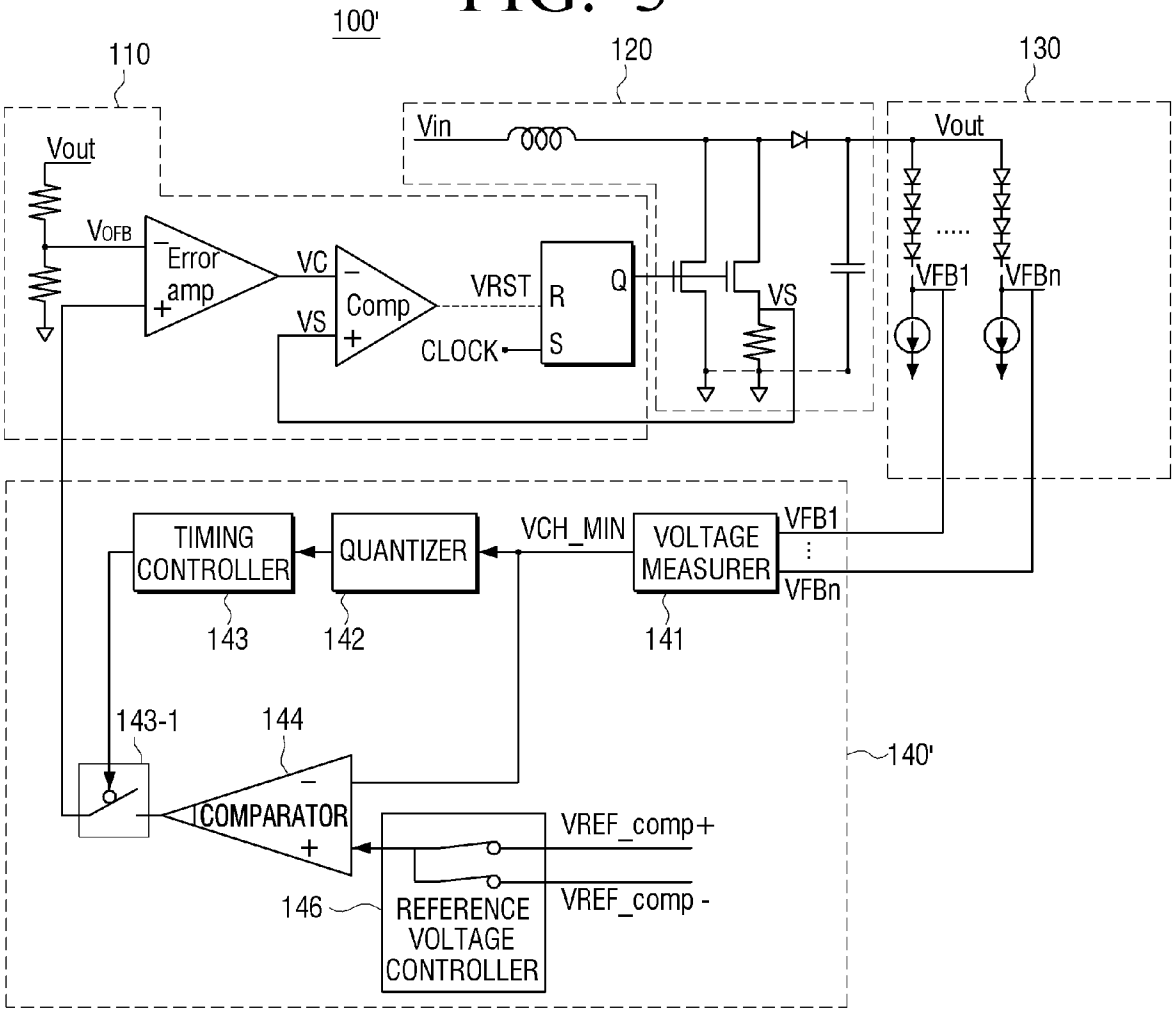
FIG. 3 is a circuit diagram illustrating another example of an LED driver circuit.

FIG. 3 is a circuit diagram illustrating an example of an LED driver circuit 100'.

Referring to FIG. 3, the LED driver circuit 100' includes a PWM signal generator 110, a DC-DC converter 120, a plurality of LED arrays 130, and a reference voltage generating circuit 140'.

The PWM signal generator 110, the DC-DC converter 120, and the plurality of LED arrays 130 have the same structures as those of the PWM generator 110, the DC-DC converter 120, and the plurality of LED arrays 130 of FIG. 2, and thus their detailed descriptions will be omitted herein.

The reference voltage generating circuit 140' includes a voltage measurer 141, a quantizer 142, a timing controller 143, a comparator 144 (or I generator), and a reference voltage controller 146. In comparison with the reference voltage generating circuit 140 of FIG. 2, the reference voltage generating circuit 140' further includes the reference voltage controller 146.

The reference voltage controller 146 provides one of a plurality of preset comparison voltages to the comparator 144 according to a level of a lowest feedback voltage. In other words, the reference voltage controller 146 receives a plurality of different comparison voltages VREF_comp+ and VREF_comp− from an external source and provides comparison voltages respectively corresponding to levels of input feedback voltages to the comparator 144.

For example, if comparison voltages of 1V, 2V, and 3V are used, and a level of an input feedback voltage is between 0V and 1.5V, the reference voltage controller 146 provides the comparison voltage of 1V to the comparator 144. If the level of the input feedback voltage is between 1.5V and 3V, the reference voltage controller 146 provides the comparison voltage of 2V to the comparator 144. If the level of the input feedback voltage is between 3V and 4.5V, the reference voltage controller 146 provides the comparison voltage of 3V to the comparator 144. In the general aspect, a level of an input feedback voltage is divided into three areas to use three comparison voltages. However, the level of the input feedback voltage may be divided into two or four areas.

The reference voltage controller 146 may provide a comparison voltage having a hysteresis form to the comparator 144. For example, the reference voltage controller 146 receives a plurality of different comparison voltages (e.g., first comparison voltages VREF_comp+) and second comparison voltages VREF_comp− lower than the first comparison voltages VREF_comp+ from the external source. If a level of a lowest feedback voltage is higher than a preset reference voltage difference, the reference voltage controller 146 provides the first comparison voltages VREF_comp+ to the comparator 144. If the level of the lowest feedback voltage is lower than the preset reference voltage difference, the reference voltage controller 146 provides the second comparison voltages VREF_comp− to the comparator 144.

Figure 4:
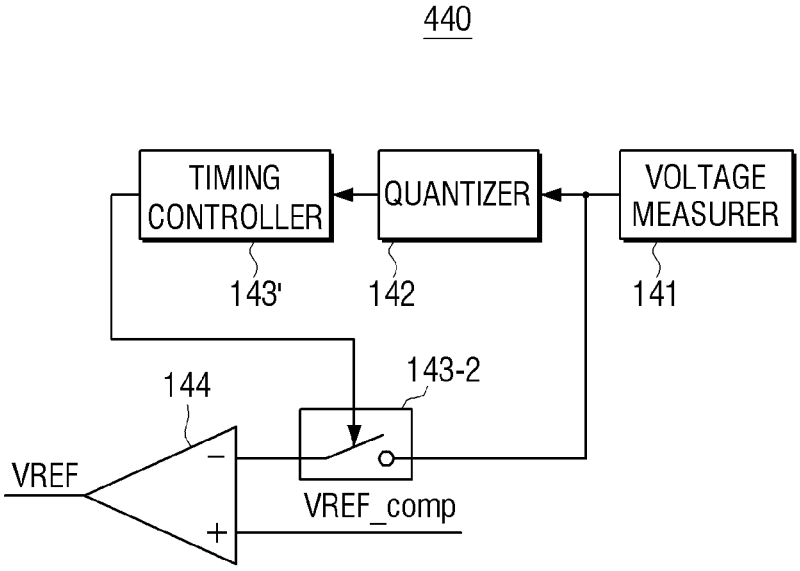
FIG. 4 is a block diagram illustrating an example of a reference voltage generating circuit.

FIG. 4 is a block diagram illustrating an example of a reference voltage generating circuit 440.

Referring to FIG. 4, the reference voltage generating circuit 440 includes a voltage measurer 141, a quantizer 142, a timing controller 143', and a comparator 144. The reference voltage generating circuit 440 of FIG. 4 is different from the reference voltage generating circuit 140 of FIG. 2 in that a connection order of the timing controller 143, a second switch 143-2, and the comparator 144 is different from that of the timing controller 143, the first switch 143-1, and the comparator 144 of FIG. 2.

The voltage measurer 141 and the quantizer 142 of FIG. 4 have the same structures as the voltage measurer 141 and the quantizer 142 of FIG. 2, and thus their repeated descriptions will be omitted herein.

The timing controller 143' provides a measured voltage value of the voltage measurer 141 to the comparator 144 at a timing when measuring a lowest feedback voltage. In other words, the timing controller 143' receives a timing when measuring a lowest feedback voltage of an LED array having the lowest feedback voltage from the quantizer 142. The timing controller 143' also provides a feedback voltage, which is measured by the voltage measurer 141, to the comparator 144 only at the received timing, using the second switch 143-2 disposed at a negative input port of the comparator 144.

For example, the voltage measurer 141 sequentially measures and feedback voltages of the plurality of LED arrays 130 and sequentially outputs the measured feedback voltages of the plurality of LED arrays 130. Therefore, the timing controller 143' provides only a lowest feedback voltage of an LED string having the lowest feedback voltage, which is measured by the voltage measurer 141, to the comparator 144 using the second switch 143-2.

The comparator 144 receives the feedback voltage measured by the voltage measurer 141 through the second switch 143-2. However, as described above, the timing controller 143' provides the comparator 144 with the lowest feedback voltage measured by the voltage measurer 141 only at the timing when measuring the lowest feedback voltage. Therefore, the comparator 144 outputs a difference between a comparison voltage and the received lowest feedback voltage as a reference voltage only at the timing when measuring the lowest feedback voltage of the LED string having the lowest feedback voltage.

According to teachings above, there is provided a LED driver circuit, which may generate a reference voltage corresponding to a lowest feedback voltage to perform LED driving controls, thereby improving operation efficiency. The LED driver circuit may use the reference voltage corresponding to a LED string only at a timing when measuring a lowest feedback voltage of the LED string having the lowest voltage, thereby stabilizing an output voltage provided to the LED string and preventing audible noise from being generated.

According to teachings above, there is provided a timing controller of a reference voltage generating circuit which may provide a reference voltage corresponding to an LED string having a lowest feedback voltage only at a timing when measuring the lowest feedback voltage of the LED string, thereby stabilizing an output voltage provided to the LED string, and preventing audible noise from being generated.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A reference voltage generating circuit used for a light-emitting diode (LED) driver circuit, the reference voltage generating circuit comprising:

a voltage measurer configured to sequentially measure feedback voltages of a plurality of LED arrays, the LED arrays being connected to one another in parallel;

a quantizer configured to search for one of the plurality of LED arrays having a lowest feedback voltage of the measured feedback voltages;

a comparator configured to compare an output of the voltage measurer with a preset comparison voltage to generate a reference voltage; and a timing controller configured to control the comparator to output the generated reference voltage corresponding to the one of the plurality of LED arrays.

2. The reference voltage generating circuit of claim 1, wherein the voltage measurer is further configured to sequentially measure voltages of nodes having differences between voltages of the plurality of LED arrays and a voltage that is commonly supplied to the plurality of LED arrays to determine the feedback voltages of the plurality of LED arrays.

3. The reference voltage generating circuit of claim 1, wherein the quantizer is further configured to search for the one of the plurality of LED arrays having the lowest feedback voltage of the measured feedback voltages and a timing when measuring the lowest feedback voltage of the one of the plurality of LED arrays.

4. The reference voltage generating circuit of claim 3, wherein the timing controller is further configured to output an output of the comparator as a reference voltage for driving the plurality of LED arrays at the timing by using a first switch disposed at an output port of the comparator.

5. The reference voltage generating circuit of claim 3, wherein the timing controller is further configured to supply an output of the voltage measurer to a negative input port of the comparator at the timing by using a second switch disposed at the negative input port of the comparator.

6. The reference voltage generating circuit of claim 1, further comprising a reference voltage controller configured to provide the preset comparison voltage to the comparator, the preset comparison voltage being one of a plurality of preset comparison voltages, the one of the plurality of preset comparison voltages being selected to be the preset comparison voltage according to a level of the lowest feedback voltage.

7. The reference voltage generating circuit of claim 6, wherein:

the plurality of preset comparison voltages comprises a first comparison voltage and a second comparison voltage that is less than the first comparison voltage;

if the level of the lowest feedback voltage is greater than a preset reference voltage difference, the reference voltage controller provides the first comparison voltage as the preset comparison voltage to the comparator; and if the level of the lowest feedback voltage is less than the preset reference voltage difference, the reference voltage controller provides the second comparison voltage as the preset comparison voltage to the comparator.

8. The reference voltage generating circuit of claim 6, wherein the reference voltage controller is further configured to provide a comparison voltage having a hysteresis form as the preset comparison voltage to the comparator.

9. A light-emitting diode (LED) driver circuit, comprising:

a plurality of LED arrays, the LED arrays being connected to one another in parallel;

a reference voltage generating circuit configured to sequentially measure feedback voltages of the plurality of LED arrays, and output a reference voltage corresponding to a lowest feedback voltage only at a timing when measuring the lowest feedback voltage of an LED array having the lowest feedback voltage;

a pulse width modulation (PWM) signal generator configured to generate a PWM signal according to the generated reference voltage; and a direct current (DC)-to-DC converter configured to provide an output voltage to the plurality of LED arrays using the generated PWM signal.

10. The LED driver circuit of claim 9, wherein the reference voltage generating circuit comprises:

a voltage measurer configured to sequentially measure the feedback voltages of the plurality of LED arrays;

a quantizer configured to search for one of the plurality of LED arrays having the lowest feedback voltage of the measured feedback voltages;

a comparator configured to compare an output of the voltage measurer with a preset comparison voltage to generate the reference voltage; and a timing controller configured to control the comparator to output the generated reference voltage corresponding to the one of the plurality LED arrays.

11. The LED driver circuit of claim 10, wherein the voltage measurer is further configured to sequentially measure voltages of nodes having differences between voltages of the plurality of LED arrays and the output voltage provided from the DC-DC converter, to measure the feedback voltages of the plurality of LED arrays.

12. The LED driver circuit of claim 10, wherein the quantizer is further configured to search for the one of the plurality of LED arrays having the lowest feedback voltage of the measured feedback voltages and a timing when measuring the lowest feedback voltage of the one of the plurality of LED arrays.

13. The LED driver circuit of claim 12, wherein the timing controller is further configured to provide an output of the comparator to the PWM signal generator at the timing.

14. The LED driver circuit of claim 12, wherein the timing controller is further configured to supply the feedback voltages, which are measured by the voltage measurer, to a negative input port of the comparator at the timing.

15. The LED driver circuit of claim 10, wherein the reference voltage generating circuit further comprises a reference voltage controller configured to provide the preset comparison voltage to the comparator, the preset comparison voltage being one of a plurality of preset comparison voltages, the one of the plurality of preset comparison voltages being selected to be the preset comparison voltage according to a level of the lowest feedback voltage.

16. The LED driver circuit of claim 15, wherein:

the plurality of preset comparison voltages comprises a first comparison voltage and a second comparison voltage that is less than the first comparison voltage;

if the level of the lowest feedback voltage is greater than a preset reference voltage difference, the reference voltage controller provides the first comparison voltage as the preset comparison voltage to the comparator; and if the level of the lowest feedback voltage is less than the preset reference voltage difference, the reference voltage controller provides the second comparison voltage as the preset comparison voltage to the comparator.

17. The LED driver circuit of claim 15, wherein the reference voltage controller is further configured to provide a comparison voltage having a hysteresis form as the preset comparison voltage to the comparator.

* * * * *